US009132561B2

(12) United States Patent
Leventhal et al.

(10) Patent No.: US 9,132,561 B2
(45) Date of Patent: Sep. 15, 2015

(54) LABORATORY CUTTING DEVICE

(71) Applicants: Margret E. Leventhal, Berkeley, CA (US); Kent F. McCue, Berkeley, CA (US); John D. McCue, Berkeley, CA (US)

(72) Inventors: Margret E. Leventhal, Berkeley, CA (US); Kent F. McCue, Berkeley, CA (US); John D. McCue, Berkeley, CA (US)

( * ) Notice: Subject to any disclaimer, the term of this patent is extended or adjusted under 35 U.S.C. 154(b) by 241 days.

(21) Appl. No.: 13/802,694

(22) Filed: Mar. 13, 2013

(65) Prior Publication Data

US 2014/0260843 A1 Sep. 18, 2014

(51) Int. Cl.

| | |
|---|---|
| ***B26B 27/00*** | (2006.01) |
| ***B26B 5/00*** | (2006.01) |
| ***B26B 9/00*** | (2006.01) |

(52) U.S. Cl.

CPC . *B26B 27/00* (2013.01); *B26B 5/00* (2013.01); *B26B 9/00* (2013.01); *Y10T 83/04* (2015.04)

(58) Field of Classification Search

CPC .... B26B 27/00; B26B 27/005; B26B 27/007; B26B 29/00; B26B 29/02; B26B 29/06; B26B 1/08; B26B 1/10; B26B 3/06; B26B 3/08; B26B 5/00; B26B 9/00

USPC ..... 30/2, 314, 330, 151, 162, 164, 329, 30/335, 340

See application file for complete search history.

(56) References Cited

U.S. PATENT DOCUMENTS

| | | | | | |
|---|---|---|---|---|---|
| 1,442,559 | A | * | 1/1923 | Doty | 30/335 |
| 2,681,504 | A | * | 6/1954 | Fox | 30/123 |
| 4,617,738 | A | | 10/1986 | Kopacz | |
| 4,711,031 | A | * | 12/1987 | Annello | 30/294 |
| 4,860,452 | A | * | 8/1989 | Guarnaccia et al. | 30/346.6 |
| 4,916,816 | A | | 4/1990 | Richman | |
| 5,007,171 | A | * | 4/1991 | Horning, Jr. | 30/294 |
| 5,430,942 | A | | 7/1995 | Doucette | |
| 5,868,771 | A | * | 2/1999 | Herbert et al. | 606/167 |
| 5,890,293 | A | * | 4/1999 | Gamba | 30/125 |
| 6,547,098 | B1 | | 4/2003 | Kay | |
| 2003/0009887 | A1 | * | 1/2003 | Cybulski | 30/162 |
| 2011/0219630 | A1 | * | 9/2011 | Johanson | 30/289 |

* cited by examiner

*Primary Examiner* — Phong Nguyen
(74) *Attorney, Agent, or Firm* — Trojan Law Offices

(57) ABSTRACT

The present invention is directed to a combination blade and blade holder for performing a plurality of laboratory applications. The combination blade and blade holder comprises a blade having an elongated body portion with a front surface, a rear surface, a first edge and a second edge joined by way of a pair of opposing side edges, a blade cutting edge extending along the first edge and a blade handle formed along the second edge and the blade holder comprising a holder body having a top edge, a bottom edge, a front surface, a rear surface, a proximal end and a distal end, and a retaining flap positioned at the proximal end to receive and hold the blade firmly. The blade, the blade handle, the blade holder and the retaining flap are designed in such a way to hold the blade in position for performing the plurality of laboratory applications.

7 Claims, 8 Drawing Sheets

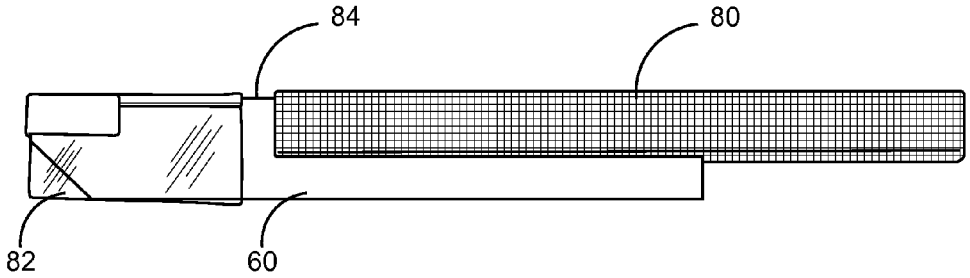
FIG. 9A
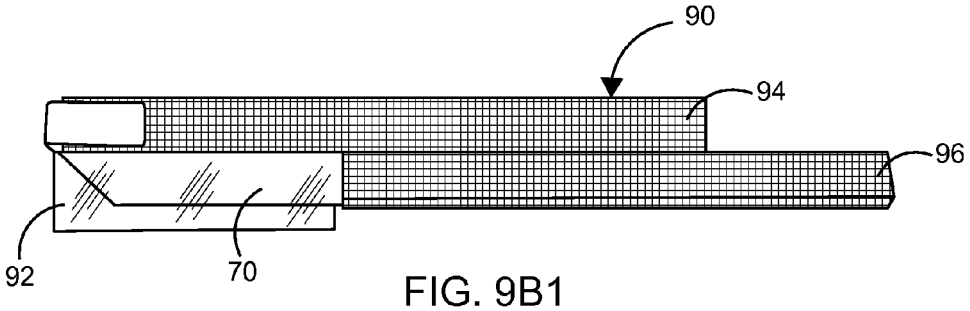
FIG. 9B1
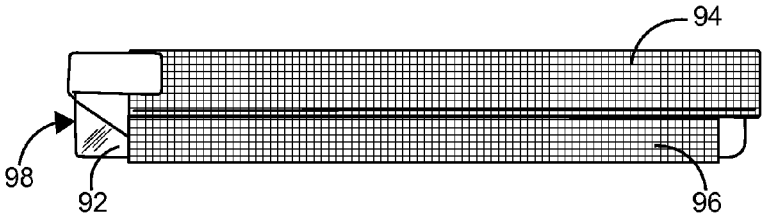
FIG. 9B2

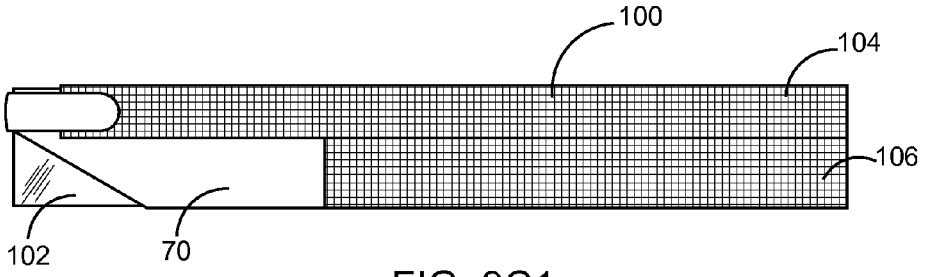
FIG. 9C1
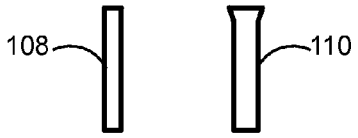
FIG. 9C2
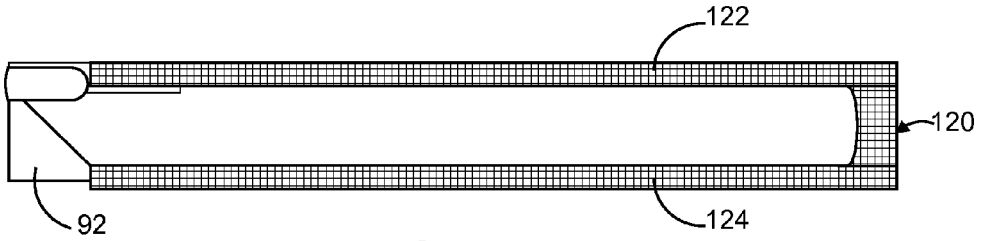
FIG. 9D1
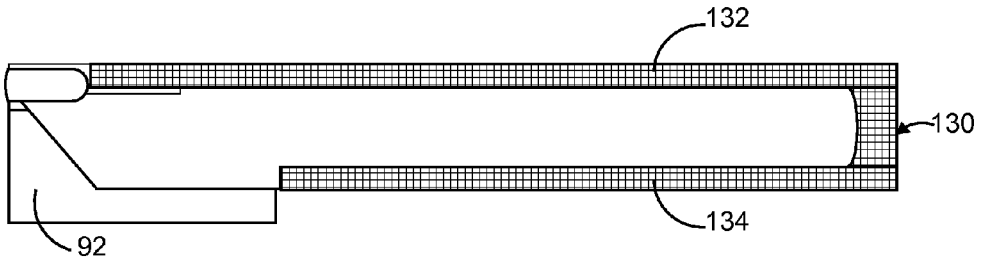
FIG. 9D2

LABORATORY CUTTING DEVICE

RELATED APPLICATIONS

Not Applicable

BACKGROUND OF THE DISCLOSURE

1. Technical Field of the Disclosure

The present embodiment relates in general to a device and method for performing specific laboratory tasks. More particularly, the present embodiment relates to a combination laboratory cutting tool and tool holder for use with laboratory applications.

2. Description of the Related Art

It has been a common practice to adapt tools that are not specifically designed for use, in order to accomplish specific laboratory tasks. Laboratory scientists use single edge razors as sample cutting, chopping, mincing and extracting tools. Some even use glass microscope slides for similar purposes. The use of such tools carries inherent risks and the tool is often exposed to dangerous chemicals or dangerous biological samples that further create disposal and health issues. In addition, the lab scientist risks personal injury and potentially blood contact with the chemicals and biological samples.

Gel extraction or gel isolation is the process of removing a small slice of gel from the larger nucleic acid or protein gel by placing it on the surface of a light box comprising a clear plastic surface and an internal UV light. The light illuminates the gel from beneath thereby causing the DNA or protein bands in the gel to standout and allowing the technician to identify bands that need to be cut out of the gel for downstream processing. This is commonly accomplished with the use of industrial single edge metal razors or glass microscope slips. These sharp tools often scratch the surfaces of the light box and thus damage the surface of light boxes. Further the nucleic acid gels are often made with ethidium bromide, a mutagenic chemical which becomes toxic when used in contact with skin or mixed with blood. The sharp tools can lead to cuts in laboratory gloves and technician's skin causing exposure to dangerous biological pathogens. These metal razors and glass slips damages the work surface thereby allowing chemicals or pathogens to seep into the underlying material. Additionally, these tools conduct electricity and extremes in temperature making them difficult to handle with samples that are extremely cold or hot and inappropriate for use around electrical wires. Furthermore, the razors are difficult to hold thereby increasing the potential for accidental injury. Moreover, these tools are not autoclavable and hence cannot be sterilized. While there are tools that employ efficient means for performing laboratory applications, none have provided satisfactory means of ensuring safety to the user.

For example, U.S. Pat. No. 6,547,098 issued to Kaye on Apr. 15, 2003 discloses a decorating and cutting device with cutting device blade biasing. The device includes a housing within which a cutting blade and decorating material dispenser are disposed and are operable to simultaneously dispense decorating material and/or cut a target material. The cutting blade is biased within the housing to prevent unintentional operation. While the device discloses a decorating and cutting device, such device is not meant to be used for laboratory applications in a manner similar to the present invention.

Another example includes U.S. Pat. No. 5,430,942 issued to Doucette on Jul. 11, 1995 that teaches a surgical blade holder and blade combination. The combination allows simple insertion of a plurality of blades. The holder includes a fixed portion and a rotatable portion that pivot relative to one another in the same longitudinal plane around a pivot point positioned adjacent the blade receiving area and lock together to securely hold the blade in the blade receiving area. While the fixed portion of the holder is gripped in one hand, the thumb or finger of the same hand is used to unlock and rotate the rotatable portion to release and eject the blade single handedly, without touching the blade. However, the device is difficult to be assembled by the user. Further, the device does not facilitate bending or bowing of the blade in a manner similar to the present invention.

Similarly, U.S. Pat. No. 4,916,816 issued to Richman on Apr. 17, 1990 describes a razor blade holder. The device includes a handle member having a razor blade retaining channel at one end and a finger grip at the other. A malleable metal razor blade support protruding from below the razor blade retainer end is adapted for threading through the central apertures of a conventional double edged razor blade. The malleable metal blade support is then bent to maintain the cutting edges of the razor in a curved position. In the razor blade holder taught by Richman, the razor blade is made of metal which conducts electricity thereby making it difficult to handle with biological samples that are extremely cold or hot. The metal blade is also not suitable for use when cutting DNA or protein Gels due to damage to the work surface.

Likewise, U.S. Pat. No. 4,617,738 issued to Kopacz on Oct. 21, 1986 discloses a surgical blade handle for removably holding a substantially planar surgical blade. The blade handle includes a rearward end to be held by the user and a forward end. An elongate tang at the forward end includes a proximal end, a distal end and a boss projecting outwardly from a side of the tang adjacent to the distal end thereof. This tang includes a pair of opposed longitudinal grooves extending from the distal end to the proximal end of the tang wherein the grooves run substantially along the interface of the tang and the boss. The tang also includes a relief recess projecting into the boss to a depth at least as deep as that portion of the boss extending outwardly from the grooves. While the surgical blade handle enables holding of surgical blades, the handle does not facilitate folding of the blade in a manner similar to the present invention.

Accordingly, there is a need for a laboratory tool that would be used in biological applications to perform specific laboratory tasks. In particular, there is a continuing need for a tool that avoids the safety risk when dealing with dangerous chemicals and biological samples to prevent health issues. Such a tool would include a combination blade and blade holder for allowing the user to perform laboratory tasks with ease. Such a tool would include a retaining flap to hold the blade in position. Such a tool would be used to manipulate, collect, slice, smash, cut, chop or mince biological samples. The tool would be designed in such a way the user can easily bend or bow the blade according to the intended use. Finally, such a tool would be easily assembled by the user.

SUMMARY OF THE DISCLOSURE

The present invention is directed to a combination blade and blade holder for performing a plurality of laboratory applications. In a preferred embodiment of the present invention as discussed herein, combination blade and blade holder comprises a blade having an elongated body portion with a front surface, a rear surface, a first edge and a second edge joined by way of a pair of opposing side edges, a blade cutting edge extending along the first edge and a blade handle formed along the second edge and the blade holder comprising a holder body having a top edge, a bottom edge, a front surface, a rear surface, a proximal end and a distal end, and a retaining flap positioned at the proximal end to receive and hold the blade firmly. The blade, the blade handle, the blade holder and the retaining flap are designed in such a way to hold the blade in position for performing the plurality of laboratory applications.

A method for using the combination blade and blade holder is accomplished by initially placing the blade on the blade holder and positioning the blade handle on the top edge of the blade holder. Then, the retaining flap of the blade holder is folded towards the front surface of the blade holder for holding the blade in position. The index finger of a user is then placed on the top edge of the blade holder and pressure is applied on the blade to perform at least one laboratory application. Then at least one laboratory application is selected from a group consisting of: manipulating, collecting, slicing, smashing, cutting, chopping and mincing biological samples.

The blade can be manufactured as small, standardized and large sizes in order to provide flexibility to the user. The blade can be made from any type of plastic selected from a group consisting of: PET, PP, PC, PMMA, PETG, PVC, PE, PS, PA, ABS, EVA, EPS, HIPS, SAN, RPET, CPET, APET, TPU, TPR, Synthetic Butyl Rubber, polyesters, homopolymers and copolymers. The blade holder can be made in small, standardized and large sizes to specifically fit each of the three blade sizes. The blade holder can be made of any type of plastic selected from a group consisting of: PET, PP, PC, PMMA, PETG, PVC, PE, PS, PA, ABS, EVA, EPS, HIPS, SAN, RPET, CPET, APET, TPU, TPR, Synthetic Butyl Rubber, Polyesters, homopolymers and Copolymers and also from any type of metal including but not limited to: aluminum, steel, stainless steel, or other metals to make the holder autoclavable and non-conductive.

One objective of the invention is to provide a laboratory tool that can be used to perform a plurality of laboratory applications.

A second objective of the invention is to provide a blade that can be manufactured in desired sizes to provide flexibility to the user.

A third objective of the invention is to provide a blade holder that can be manufactured to specifically fit the desired blade sizes.

Another objective of the present invention is to provide a blade adaptable to be mounted to the blade holder so as to provide ease of use to the user.

Yet another objective of the present invention is to provide a method for using the combination blade and blade holder to perform a plurality of laboratory applications.

Still another objective of the present invention is to provide a tool that can be used as a chopper, mincer or slicing tool for biological samples.

These and other advantages and features of the present invention are described with specificity so as to make the present invention understandable to one of ordinary skill in the art.

BRIEF DESCRIPTION OF THE DRAWINGS

In order to enhance their clarity and improve understanding of these various elements and embodiments of the invention, elements in the figures have not necessarily been drawn to scale. Furthermore, elements that are known to be common and well understood to those in the industry are not depicted in order to provide a clear view of the various embodiments of the invention, thus the drawings are generalized in form in the interest of clarity and conciseness.

FIGS. 9A-9D2 illustrate perspective views of the present invention, showing a sleeve in use with the combination blade and blade holder.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below. Finally, many of the steps are presented below an order intended only as an exemplary embodiment. Unless logically required, no step should be assumed to be required earlier in the process than a later step simply because it is written first in this document.

Figure 1:
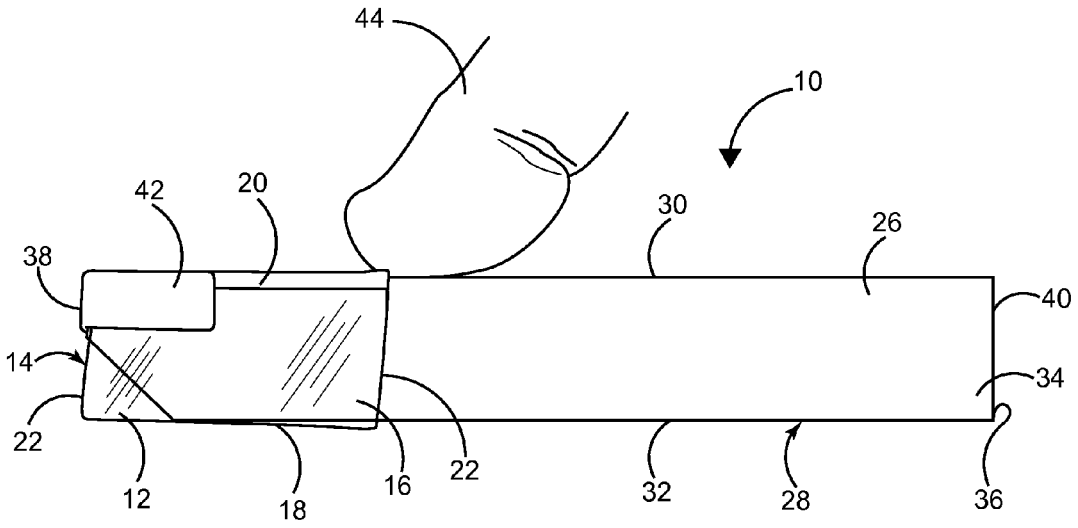
FIG. 1 illustrates a perspective view of a combination blade and blade holder in use in accordance with a preferred embodiment of the present invention.

Turning first to FIG. 1, a perspective view of a combination blade and blade holder 10 in accordance with a preferred embodiment of the present invention is illustrated. The combination blade and blade holder 10 includes a blade 12 comprising an elongated body portion 14 having a front surface 16, a rear surface, a first edge 18 and a second edge 20 joined by way of a pair of opposing side edges 22, a blade cutting edge extending along the first edge 18 and a blade handle 24 formed along the second edge 20; and a blade holder 26 comprising a holder body 28 having a top edge 30, a bottom edge 32, a front surface 34, a rear surface 36, a proximal end 38 and a distal end 40, and a retaining flap 42 positioned at the proximal end 38 to receive the blade 12. The blade holder 26, the blade handle 24 and the retaining flap 42 are designed in such a way to hold the blade 12 in position for performing the plurality of laboratory applications. The at least one laboratory application is selected from a group consisting of: manipulating, collecting, slicing, smashing, cutting, chopping and mincing biological samples.

The combination blade and blade holder 10 can be used by initially placing the blade 12 on the blade holder 26 and positioning the blade handle 24 on the top edge of the blade holder 30. Then, the retaining flap 42 of the blade holder 26 is folded towards the front surface 34 of the blade holder 26 for holding the blade 12 in position. Alternately, the blade handle 24 can be placed on the top edge of the blade holder 30 and the retaining flap 42 of the blade holder 26 can be folded towards the rear surface 36 of the blade holder 26 for holding the blade 12 in position. The index finger of a user 44 is then placed on the top edge of the blade holder 30 and pressure is applied on the blade 12 to perform at least one laboratory application. The blade handle (FIG. 3, 24) is positioned on the holder 30 such that the top edge of the holder is placed inside the gap formed by the blade handle (FIG. 3, 24) and the surface of the blade, thus securing the blade 12 to the holder 26 vertically. The blade 12 slides under the retaining flap 42, thereby securing the blade 12 horizontally. This can be accomplished by positioning the flap 42 on either side of the holder 30 without changing the outcome.

Figure 2A:
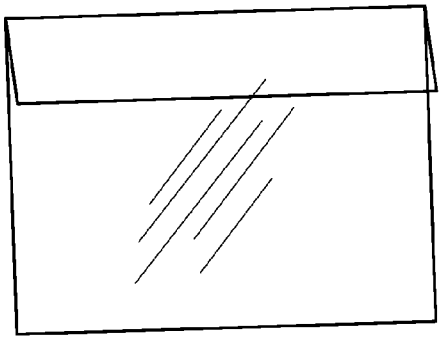
FIGS. 2A-2C illustrate perspective views of preferred embodiments of a blade in accordance with the present invention.
Figure 2B:
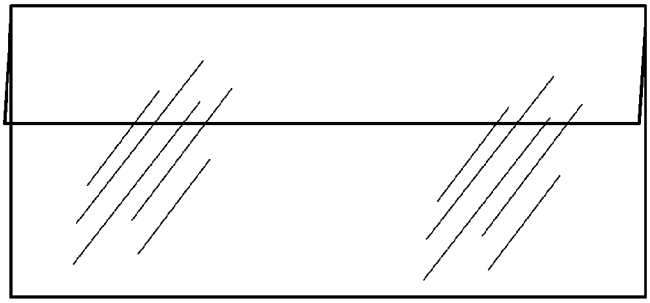
Figure 2C:
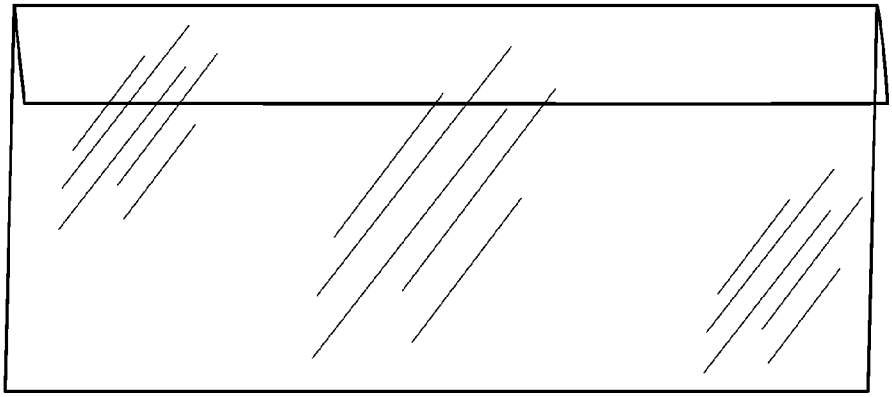

FIGS. 2A-2C illustrate perspective views of preferred embodiments of the blade 12 in accordance with the present invention. The blade 12 of the present invention can be manufactured as small, standardized and large sizes in order to provide flexibility to the user. FIG. 2A illustrates a small sized blade and FIG. 2B illustrates a standardized blade. In FIG. 2C, large size blade is illustrated. In all of these preferred embodiments, the blade thickness will be 0.009 inches. According to the user's preference, the blade 12 can be used with or without the blade holder and the blade handle. Any edge of the blade 12 can be used as the cutting edge without the handle.

The blade 12 can be made from any type of plastic selected from a group consisting of: PET, PP, PC, PMMA, PETG, PVC, PE, PS, PA, ABS, EVA, EPS, HIPS, SAN, RPET, CPET, APET, TPU, TPR, Synthetic Butyl Rubber, polyesters, homopolymers and copolymers. The plastic used may be provided with additives to make the blade 12 hydrophobic or anti-static so that highly static materials are repelled from the blade. In addition, additives that accelerate the decomposition of the plastic in the traditional waste stream may be employed to make the blade more environmentally friendly. The choice of the plastic used in the manufacture of the blade 12 can also make the blade 12 autoclavable for sterile applications. For instance, polypropylene is a polymer that is autoclavable. The choice of the plastic can also make the blade customizable by the use, e.g. the use of PP will allow the user to cut the blade to a specific size as needed.

Figure 3:
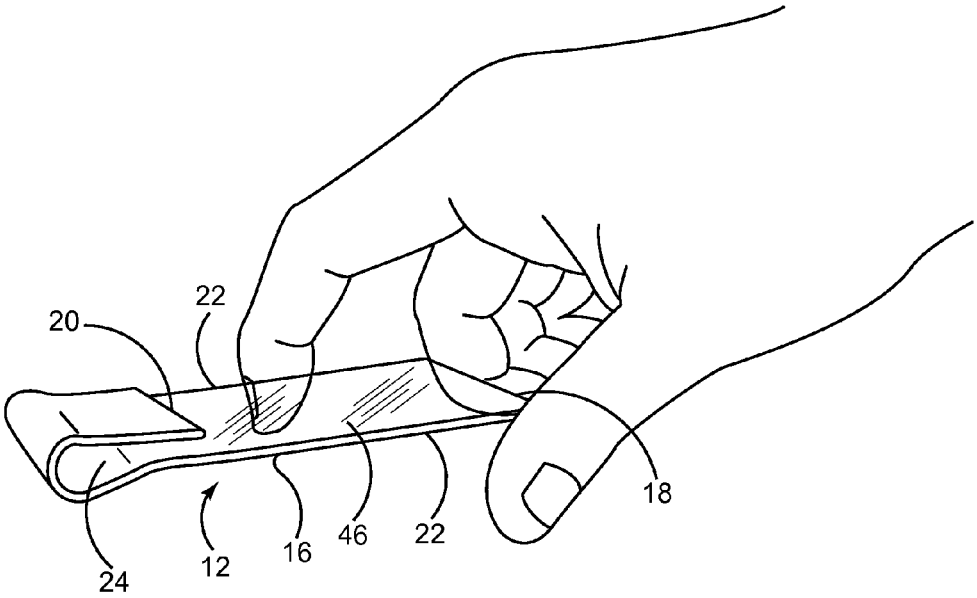
FIG. 3 illustrates a side perspective view of the blade of the present invention.

Referring to FIG. 3, a side perspective view of the blade 12 of the present invention is illustrated. The blade 12 comprises the elongated body portion 14 having the front surface 16, the rear surface 46, the first edge 18 and the second edge 20 joined by way of a pair of opposing side edges 22, a blade cutting edge extending along the first edge 18 and a blade handle 24 formed along the second edge 20. The blade handle 24 is formed by folding the blade handle 24 along the second edge 20 to provide easy gripping to the user while holding the blade 12 to perform at least one laboratory application. The blade 12 is mounted on the blade holder 26 by positioning the blade handle 24 on the top edge of the blade holder 30. The blade handle 24 provides easier gripping and additional firmness to the blade 12.

Figure 4A:
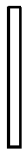
FIGS. 4A-4C illustrate cross sectional views of various designs of a blade edge in accordance with an alternate embodiment of the present invention.
Figure 4B:
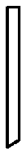
Figure 4C:
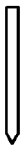

FIGS. 4A-4C illustrate cross sectional views of various designs of a blade edge in accordance with an alternate embodiment of the present invention. The blade 12 of the present invention can be manufactured with different cutting edge designs. FIG. 4A and FIG. 4B specifically illustrates cross sectional views of square and single bevel edges of the blade 12 respectively. In FIG. 4C, a double bevel edge is illustrated. These edge designs can be applied to any single, multiple or all edges of the blade 12.

Figure 5:
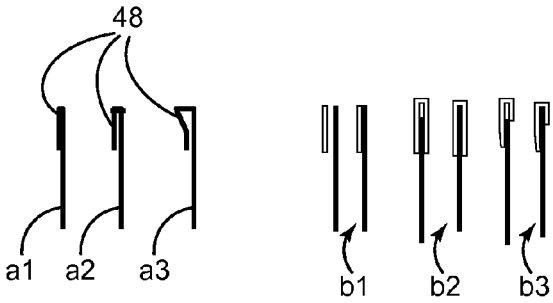
FIG. 5 illustrates cross sectional views of various embodiments of the blade handle in accordance with an alternate embodiment of the present invention.

FIG. 5 illustrates cross sectional views of alternate embodiments of the blade handle 24 in accordance with an alternate embodiment of the present invention. The edge associated with the blade handle 24 can be square, rounded, angled or any combination thereof. Referring to FIG. 5, embodiment a1 illustrates a blade handle in which a flap of material 48 is folded and pressed firmly to the rear surface of the blade 46. In this design, the flap 48 is secured to the rear surface 46 via a method appropriate to the manufacturing process chosen. Methods such as, but not limited to, application of heat or application of an adhesive may be used. In embodiment a2, the flap 48 is folded to the rear surface of the blade 46, but not forced to remain in physical contact with the surface. In this particular embodiment, the flap 48 is not secured to the rear surface 46. Referring to embodiment a3, the edge design is created by forming a mold or extruding through a profile, or other method used by one skilled in the art, to create a unique profile for the handle. The edge of the handle created by this approach can be round, square, triangular or any other shape. This design allows movement of air through the handle region which allows the region to stay relatively cooler when exposed to heat and relatively warmer when exposed to cold. This embodiment also provides additional firmness to the blade 12.

Referring to embodiment b1, a strip of material is applied to just one surface of the blade 12. Embodiment b2 shows a handle design in which a strip of material folded at its center point and fused to the opposing surfaces of the blade 12. Alternatively, two separate strips could be applied, one to each side. Referring to b3, the embodiment shows a strip of material folded off center and fused to the opposing surfaces of the blade 12. Alternatively, two separate strips of differing widths could be applied, one to each side. The blade handle 24 can be created by joining together two separate pieces of material on their flat surfaces to create a handle. The joint can be created via application of heat, glue or any other method to fuse the materials that may be used by someone skilled in the art. In these embodiments, one can use the same material or different materials to form the handle. The strip used for this purpose maybe thinner than the blade, the same thickness as the blade, or thicker than the blade.

Figure 6A:
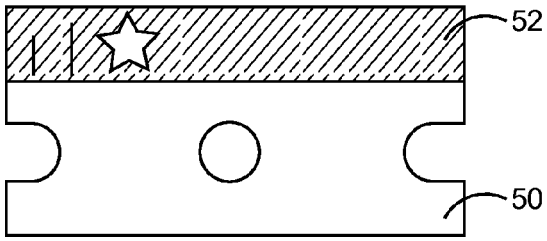
FIGS. 6A-6D illustrate top views of the present invention, showing a blade and blade handle with decorative printings in accordance with alternate embodiments of the present invention.
Figure 6B:
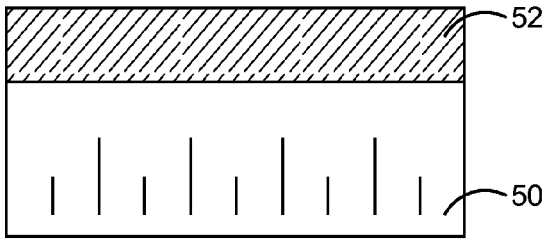
Figure 6C:
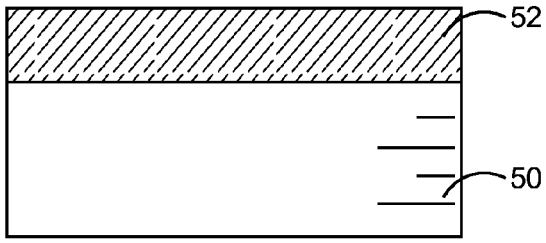
Figure 6D:
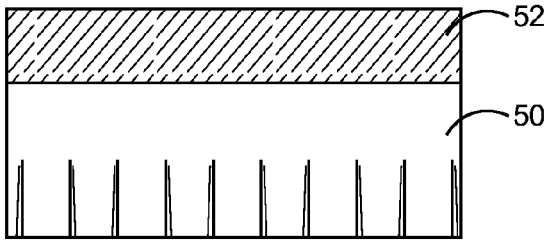

FIGS. 6A-6D illustrate top views of the present invention, showing a blade 50 and a blade handle 52 with decorative printings in accordance with alternate embodiments of the present invention. The blade handle 52 can be the same color as that of the blade 50 or a different color. In addition, the blade handle 52 may have decorative printing imprinted or embossed on it. The decorative printings can be vertical, diagonal or horizontal striations or embossing/indentations/striations to improve grip or to make length measurements. Similarly, the blade 50 may also have decorations printed, imprinted or embossed on it. FIG. 6A illustrates the blade 50 and blade handle 52 imprinted or embossed with decorations whereas FIG. 6B illustrates calibration marks to the blade 50 to allow the user to make length measurements. Referring to FIG. 6C, calibration marks are added to the blade 50 to allow the user to make depth measurements. FIG. 6D illustrates the blade 50 with square cuts formed on the first edge so as to allow the user to cut specific shapes out of objects. Lines, decorations, holes, text etc can be imprinted, embossed or otherwise applied to the surface or into the blade by one skilled in the art.

Figure 7A:
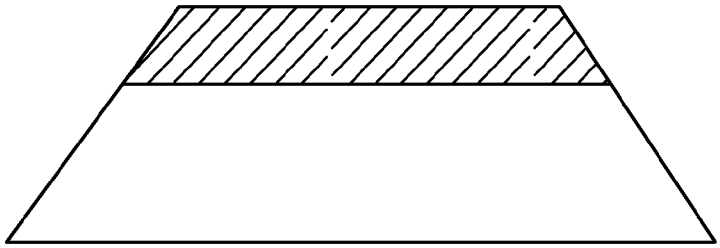
FIGS. 7A-7C illustrate alternate embodiments of the blade of the present invention.
Figure 7B:
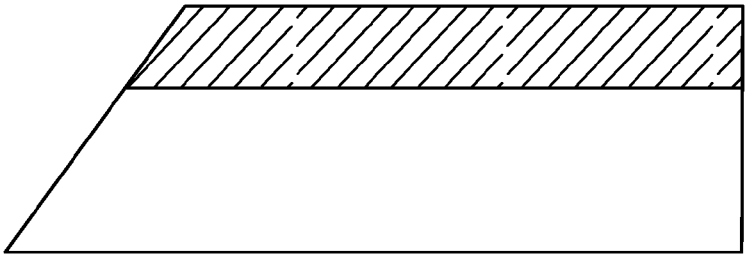
Figure 7C:
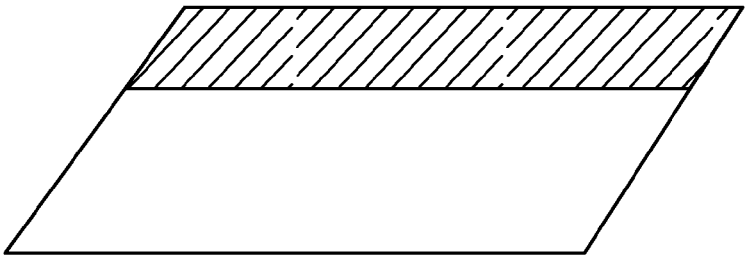

FIGS. 7A-7C illustrate alternate embodiments of the blade of the present invention. In alternate embodiments, the blade can be manufactured in various shapes including but not limited to: circle, triangle, square, rectangle, rhombus, trapezoid, parallelogram or any other appropriate shape. Referring to FIG. 7A, the blade is an isosceles trapezoid, having both congruent base angles and congruent legs, whereas FIG. 7B illustrates the blade with incongruent base angles and incongruent legs. In the embodiment in FIG. 7C, the blade is shown in the form of a parallelogram. The above referenced embodiments can be from 5 mm to 153 mm wide and 5 mm to 153 mm high, or any combination thereof. It can be from 0.10 mm to 0.50 mm thick. In all these embodiments, it is possible to add a holder into which the blade may be inserted to allow the user to distance his/her hands from the work surface or blade edges. The blade can also be manufactured to include any combination of the embodiments shown in the illustrations.

Figure 8A:
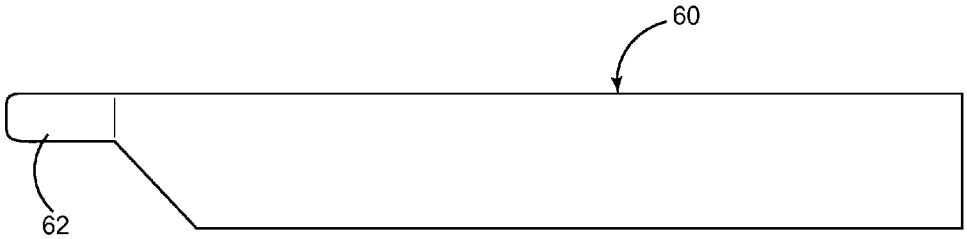
FIGS. 8A-8C illustrate alternate embodiments of the blade holder of the present invention.
Figure 8B:
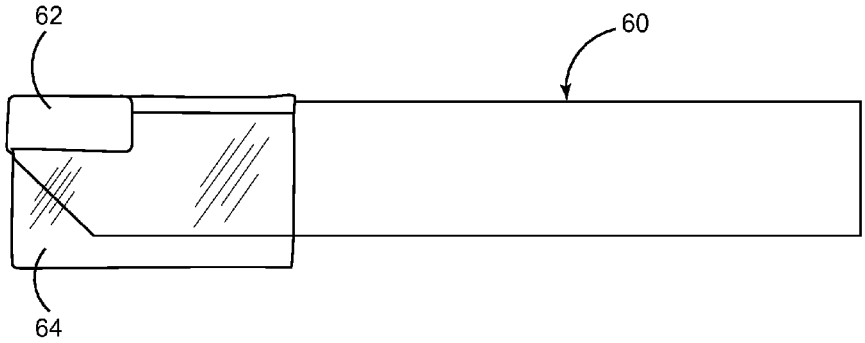
Figure 8C:
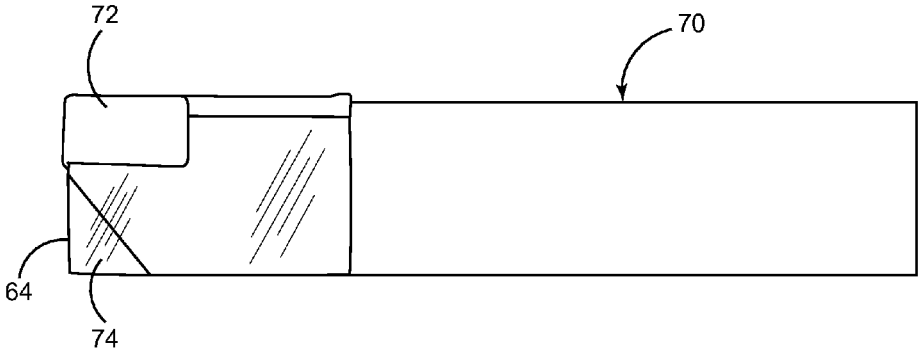

FIGS. 8A-8C illustrate alternate embodiments of the blade holder of the present invention. Referring to FIG. 8A, a small blade holder 60 with a retaining flap 62 is illustrated. The retaining flap 62 is designed to receive the blade so as to hold the blade in position. FIG. 8B illustrates the small blade holder 60 with a standardized blade 64. The blade 64 is inserted into the retaining flap 62 and the blade handle is hanging over the holder 60 such that the body of the blade is on the front surface of the holder and the blade handle is on the rear surface of the blade holder 60. In this illustration, the blade handle is inserted into the retaining flap 62. In this configuration, the blade holder 60 may provide several functions such as, but not limited to, providing additional structural rigidity to the blade, thereby allowing the user to use the blade 64 as a chopping or mincing tool and, if held at an angle, a slicing tool. In this embodiment, the retaining flap is preferably 0.1875 inches high. Referring to FIG. 8C, a large blade holder 70 used with the standardized blade 64 is illustrated. In this illustration, the standardized blade 64 is inserted into the retaining flap 72 and only a triangular section 74 of the blade 64 is revealed. The user may conveniently use the combination blade and blade holder as a slicing tool. In the large blade holder 70, the retaining flap 72 is approximately 0.75 inches, which can be altered as per user's needs.

In the preferred small and large embodiments of the holder, the thickness is defined by the gauge of the stainless steel used in the manufacture of the holder and can be from 1 to 38 gauge or 0.2813 to 0.0060 inches. The gauge can be same along the full length of the holder and the retaining flap or can be narrower along the retaining flap and wider along the handle length. The length of the holder can be 5 inches to accommodate the hand of the user or can be any length based upon the needs of the user. These embodiments illustrate some of the possible holder designs, while other approaches are also possible depending on the nature of the desired use.

Apart from the above discussed embodiments, the blade holder can be made in small, standardized and large sizes to specifically fit each of the three blade sizes, or two sizes or a single holder can be made to fit all three sizes. The holder can also be made in multiple sizes to fit different sized blades or so that its functionality is altered by the size of blade that is inserted into the holder, but are not limited to, use as a chopper/mincer and use as an slicing tool. The blade holder can be made of any type of plastic selected from a group consisting of: PET, PP, PC, PMMA, PETG, PVC, PE, PS, PA, ABS, EVA, EPS, HIPS, SAN, RPET, CPET, APET, TPU, TPR, Synthetic Butyl Rubber, Polyesters, homopolymers and Copolymers. The blade holder can also be made from any type of metal including but not limited to: aluminum, steel, stainless steel, or other metals to make the holder autoclavable and non-conductive. For instance, the blade holder can be made of a continuous piece of stainless steel, which is folded at one end to create the retaining flap designed to receive the blade. The height of the folded region can be the same as the rest of the holder or can be of a different height, either less or more. In both the small and the large embodiments, the retaining flap (62, 72) is folded such that the distance of the retaining flap from the body of the holder is initially constant and then gradually narrows toward the body which causes the retaining flap to apply pressure to the blade to assist in holding the blade.

FIGS. 9A-9D2 illustrate perspective views of the present invention, showing a sleeve in use with the combination blade and blade holder. The blade holder includes the sleeve 80 through which the holder may be passed or which may be slid over the holder depending on the design. FIG. 9A illustrates the sleeve 80 used with a small blade 82 and the small blade holder 60. Here, the sleeve 80 is represented by an open rectangular tube that can be slid along the top edge of the holder 84 by applying pressure to the holder 60 and the blade 82 mounted on the holder. FIG. 9B1 illustrates the sleeve 90 in use with combination of a standardized blade 92 and the large blade holder 70, wherein the sleeve 90 acts as a handle and holds the blade 92 in place. The sleeve 90 includes two interconnecting parts, a first part 94 and a second part 96, wherein the first part 94 includes a channel to allow the second part 96 to slide up and down the length of the first part 94. In FIG. 9B2, the second part of the sleeve 96 is slid forward in order to cover major portion of the blade 92, leaving only the corner of the blade 98 available for cutting.

Referring to FIG. 9C1, the sleeve 100 in use with a large blade 102 is illustrated. The sleeve 100 is a rectangular tube formed by folding material or through extrusion or many other possible ways by one skilled in the art. The user can attach the large blade 102 to the holder 70 and secure with first part of the sleeve 104 while extending second part of the sleeve 106 back and away from the blade 102, thereby allowing the whole of the large blade 102 to be available for cutting, chopping or mincing. In this embodiment, the large blade 102 restricts the movement of the sleeve 100 and hence the sleeve cannot move beyond the edge of the blade 102. The sleeve 100 offers a gripping surface to the user for easier handling of the holder and holds the blade 102 in place so that the user does not need to rely solely on his or her index finger to keep the blade 102 in place. FIG. 9C2 shows two possible profiles of the sleeve, wherein first profile 108 is a perfect rectangle sized to fit snuggly over the holder 70. The second profile 110 also fits snuggly over the holder 70 but narrows down from the top edge such that inside top surface of the sleeve will apply pressure to the sides of the holder and the blade on the holder. FIG. 9D1 illustrates a sleeve 120 in which the top 122 and bottom 124 of the sleeve are of the same length. In this embodiment, the rounded top and bottom of the sleeve 122, 124 provides more comfortable hand feel to the user. This design also offers gripping surface to the user for easier handling of the holder and holds the standardized blade 92 in place so that the user does not need to rely solely on his or her index finger to keep the standardized blade 92 in place. FIG. 9D2 illustrates an alternate embodiment of the sleeve shown in FIG. 9D1. Here, sleeve 130 is designed in such a way that the top of the sleeve 132 is longer than the bottom of the sleeve 134.

The sleeve can be made of can be made from any type of plastic including but not limited to: PET, PP, PC, PMMA, PETG, PVC, PE, PS, PA, ABS, EVA, EPS, HIPS, SAN, RPET, CPET, APET, TPU, TPR, Synthetic Butyl Rubber, Polyesters, homopolymers and Copolymers. The sleeve can also be made from any type of metal including but not limited to: aluminum, steel, stainless steel, or other metals. For example, sleeve can be made of stainless steel which makes the sleeve autoclavable for sterilization. In another preferred embodiment the sleeve can be made of PP or silicone rubber, which makes the sleeve autoclavable for sterilization and non-conductive. The sleeve provides additional stability to the blade and provides a wider gripping area on the holder.

The laboratory tool of the present invention is applicable for cutting any material that is soft in nature. The above disclosed blade and blade holder is primarily intended to be used in biological applications to manipulate, collect, slice, smash, cut, chop or mince biological samples. The combination blade and blade holder may be designed to be used as a chopper, mincer or slicing tool for biological samples, including but not limited to, nucleic acid or protein gels. The blade of the present invention can be manufactured as small, standardized and large sizes to provide flexibility to the user. The blade is designed in such a way that the blade can be mounted to the blade holder so as to provide ease of use to the user. The blade holder is designed to provide greater rigidity to the blade and can be manufactured as small, standardized and large sizes to match the blade sizes.

The foregoing description of the preferred embodiment of the present invention has been presented for the purpose of illustration and description. It is not intended to be exhaustive or to limit the invention to the precise form disclosed. Many modifications and variations are possible in light of the above teachings. For example, even though multiple embodiments of the blade, blade holder and sleeve have been disclosed, changes and modifications can be made without departing from the spirit of the invention. In addition, the blade can be used with or without the blade holder and the blade handle according to the user's preference. Moreover, the combination blade and blade holder can be used with or without the sleeve. It is intended that the scope of the present invention not be limited by this detailed description, but by the claims and the equivalents to the claims appended hereto.

We claim:

1. A combination blade and blade holder for performing a plurality of laboratory applications, the combination blade and blade holder comprising:

a blade comprising an elongated body portion having a front surface, a rear surface, a first edge and a second edge joined by way of a pair of opposing side edges, a blade cutting edge extending along the first edge and a blade handle formed along the second edge, wherein the blade is made of a flexible material selected from a group consisting of: PET, PP, PC, PMMA, PETG, PVC, PE, PS, PA, ABS, EVA, EPS, HIPS, SAN, RPET, CPET, APET, TPU, TPR, Synthetic Butyl Rubber, polyesters, homopolymers and copolymers;

wherein the blade cutting edge is a non-beveled square edge;

wherein the blade handle is a folded blade handle that overlaps the rear surface of the blade by folding the second edge toward the cutting edge, said second edge of said blade substantially parallel to said blade cutting edge, whereby said folded blade handle increases structural rigidity of the blade compared to a blade having a non-folded blade handle;

wherein said blade is between 0.10 and 0.50 mm thick;

a blade holder comprising a holder body having a top edge, a bottom edge, a front surface, a rear surface, a proximal end and a distal end, and a retaining flap positioned at the proximal end to receive the blade;

whereby the blade holder, the blade handle and the retaining flap are designed in such a way to hold the blade in position for performing the plurality of laboratory applications.

2. The combination blade and blade holder of claim 1 wherein the plurality of laboratory applications is selected from a group consisting of: manipulating, collecting, slicing, smashing, cutting, chopping and mincing biological samples.

3. The blade of claim 2 wherein the blade is mounted on the blade holder by positioning the blade handle on a top edge of the blade holder.

4. The blade of claim 2 wherein the blade may be manufactured in any suitable size selected from a group consisting of: small, standardized and large to provide flexibility to the user.

5. The blade of claim 2 wherein the blade handle provides additional firmness to the blade.

6. The blade of claim 2 wherein the blade is characterized as having a shape selected from the group consisting of a: circle, triangle, square, rectangle, rhombus, trapezoid, and parallelogram.

7. The blade of claim 2, wherein the blade further comprises a plurality of indentations adjacent to the blade cutting edge within the front or rear surface of the blade, whereby said plurality of indentations are used to improve grip or to make length measurements, and wherein said blade handle is substantially parallel to said rear surface of said elongated body and forms a gap between said elongated body and said blade handle.

* * * * *